US010431919B2

(12) United States Patent
Markgraf et al.

(10) Patent No.: US 10,431,919 B2
(45) Date of Patent: Oct. 1, 2019

(54) CONNECTOR FOR ELECTRICAL POWER CABLES

(71) Applicant: NEXANS, Paris (FR)

(72) Inventors: Volker Markgraf, Roslau (DE); Gert Stauch, Hof (DE); Peter Grotsch, Rehau (DE)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 15/307,677

(22) PCT Filed: Apr. 10, 2015

(86) PCT No.: PCT/EP2015/057882
§ 371 (c)(1),
(2) Date: Oct. 28, 2016

(87) PCT Pub. No.: WO2015/165720
PCT Pub. Date: Nov. 5, 2015

(65) Prior Publication Data

US 2017/0054236 A1 Feb. 23, 2017

(30) Foreign Application Priority Data

Apr. 28, 2014 (EP) ..... 14305634

(51) Int. Cl.
*H01R 13/627* (2006.01)
*H01R 13/05* (2006.01)
(Continued)

(52) U.S. Cl.
CPC ..... *H01R 13/052* (2013.01); *H01R 13/111* (2013.01); *H01R 13/621* (2013.01); *H01R 13/627* (2013.01); *H01R 2101/00* (2013.01)

(58) Field of Classification Search
CPC ..... H01R 13/052; H01R 13/24; H01R 12/58; H01R 13/111; H01R 13/621;
(Continued)

(56) References Cited

U.S. PATENT DOCUMENTS 2,308,811 A 1/1943 Jackson
3,372,476 A 3/1968 Peiffer
(Continued)

FOREIGN PATENT DOCUMENTS

CN 201985362 9/2011

OTHER PUBLICATIONS

Search Report dated Jun. 16, 2015.
Chinese Office Action dated Apr. 2, 2018.

*Primary Examiner* — Jean F Duverne
(74) *Attorney, Agent, or Firm* — Sofer & Haroun, LLP

(57) ABSTRACT

A connector (1) for two electrical energy cables is indicated. The connector (1) has a plug (2) and a socket (3) which each is able to be tightly connected and suitable to produce a releasable electrical contact between the conductors. The socket (3) has hollow space (12) running in the longitudinal direction and the plug (2) a protruding bolt (11) in the longitudinal direction which is pluggable in the hollow space (12). The hollow space (12) and the bolt (11) have the identical truncated conical shape to each other, so that the bolt (11) is fixable in the hollow space (12) in the operative position. The connector (1) has further a pin (15, 18) so arranged that its axis is right angled to a connector axis (10) of the connector (1) and interacts with a circumferential recess (17, 18) around the diameter of the bolt (11).

9 Claims, 3 Drawing Sheets

(51) Int. Cl.
*H01R 13/11* (2006.01)
*H01R 13/621* (2006.01)
*H01R 101/00* (2006.01)

(58) Field of Classification Search
CPC ..... H01R 2101/00; H01R 13/627; H01R 9/0521; H01H 39/00
USPC ..... 439/359
See application file for complete search history.

(56) References Cited

U.S. PATENT DOCUMENTS 3,624,679 A * 11/1971 Ziegler, Jr. ..... H01R 9/0521 174/88 C
4,223,179 A * 9/1980 Lusk ..... H01R 4/30 174/73.1
4,634,213 A * 1/1987 Larsson ..... H01R 4/02 174/84 R
4,867,691 A * 9/1989 Eck ..... H01R 12/58 29/843
4,878,863 A * 11/1989 Swengel, Jr. ..... H01R 13/24 439/884
5,201,914 A * 4/1993 Hollick ..... H01R 4/36 439/801
5,957,733 A * 9/1999 Mello ..... H01R 4/36 439/810
6,071,145 A * 6/2000 Toly ..... H01R 13/53 439/465
6,171,121 B1 * 1/2001 Krappel ..... H01H 39/00 439/158
7,425,152 B2 * 9/2008 Hardt ..... H01R 13/53 439/578
9,082,560 B2 * 7/2015 Helms ..... H01H 1/06
2009/0004906 A1 1/2009 Koch
2015/0132986 A1 5/2015 Schumacher

* cited by examiner

CONNECTOR FOR ELECTRICAL POWER CABLES

RELATED APPLICATIONS

This application is a National Phase Application of PCT/EP2015/057882 filed on Apr. 10, 2015, which in turn claims the benefit of European Patent Application No. 14 305 634.9, filed on Apr. 28, 2014, the entirety of which are incorporated by reference.

BACKGROUND

Field of the Invention

The invention relates to a connector for two electrical energy cables. The connector has a plug and a socket in which each a conductor cable is able to be inserted and is suitable for producing a releasable electrical contact between the conductors. The socket has a hollow space running in the longitudinal direction and the plug has a projecting bolt in the longitudinal direction which can be inserted in the hollow space.

The following described metal for the conductor or parts of the connector should also contain corresponding metal alloys.

Description of Related Art

Known connectors for electrical energy cables which are composed of two connector parts, which are each in contact with a conductor, can take different forms, some of which are mentioned in the following examples.

The connector parts can, for example, have each on an end an extension of a flat contact surface. The contact surfaces are laid one over the other and connected with a screw to establish an electrical connection between the two connector parts. To ensure a satisfactory electrical contact, the contact surfaces must be manufactured in a costly manner and with much effort tightly joined together.

According to a further example, the connector can perform as a plug connector and the socket can consist of a pin or a plug, which can be plugged into a hollow space of the socket. The socket is held with the plug by contact elements on its contact surface to establish the electrical contact between the pin and the socket by a plurality of individual contact points. It can also be the plug equipped with such contact elements. The contact elements can be composed of, for example, contact lamellae or flexible contacts. They are made of copper and silver plated, gold plated or nickel plated. The use of such contact elements in a connector is, with the manufacture and mounting in the socket or plug, connected with a higher use of material, more work time and higher cost.

As described in U.S. Pat. No. 2,308,811 A, the hollow space of the socket and the bolt of the plug can have the identical truncated conical shape to each other, so that the bolt is fixable in an operative position by self-locking. The self-locking leads to a tight releasable connection of the two connector parts. The self-locking is generated through the static friction between the precisely aligned truncated conical surface of the bolt and the hollow space. The self-locking ensures that the connector remains in the operative position as long as none of the self-locking counter-acting force, for example, a pulling force, acts on the connector parts.

OBJECTS AND SUMMARY

The invention is based on the object of providing a connector for electrical energy cables which is simply constructed, such connector parts to be connected without effort and which make possible a perfect electrical contact.

In accordance with the invention this object is met in that the connector has a pin as a locking means, which additionally holds the connector in the operative position, whereby the pin is so arranged that its axis is right angled to a connector axis of the connector and acts with a circumferential recess around the diameter of the bolt.

The connector according to the invention allows a quick and easy connection of two electrical energy cables, with no special work tools necessary. A tight self-locking releasable connection of the two connector parts is achieved by the identical truncated conical shape of the hollow space and the bolts created in the work position when the socket and the plug are plugged together. The strength of the self-locking is influenced by the surface roughness of the two cover surfaces. The locking means ensures that the connector remains securely in the operative position and does not loosen even by a force acting on it. The prefabricated connector part—plug and socket each with the attached conductors—can simply be joined together by a fitter on the spot without the plug and socket having to be put previously in a particular radial direction of each other. The connector of the cable is releasable, so that if required each of the two cables can be connected with another further cable. Furthermore, the connector according to the invention is especially cost efficient.

The connector according to the invention is advantageously suitable for the connecting of cables of the same materials or, for example, of copper—with aluminum lines in low- and middle voltage range. They are therefore, for example, suitable in wind power plants, for aluminum cable to connect tower segments together and the transition to copper lines in the nacelle and foundation manufacture.

The connector according to the invention can alternatively also serve to connect an electrical cable to an electrical device. As a result, for example, the socket is mechanically and electrically tightly connected to the device, so that the cable connected with the plug quickly and simply can be connected to the device.

BRIEF DESCRIPTION OF THE DRAWINGS

Embodiments of the state of the invention are illustrated in the drawings. In the drawings.

In the illustrations the same reference numerals are used for the same components.

DETAILED DESCRIPTION

Figure 1A:
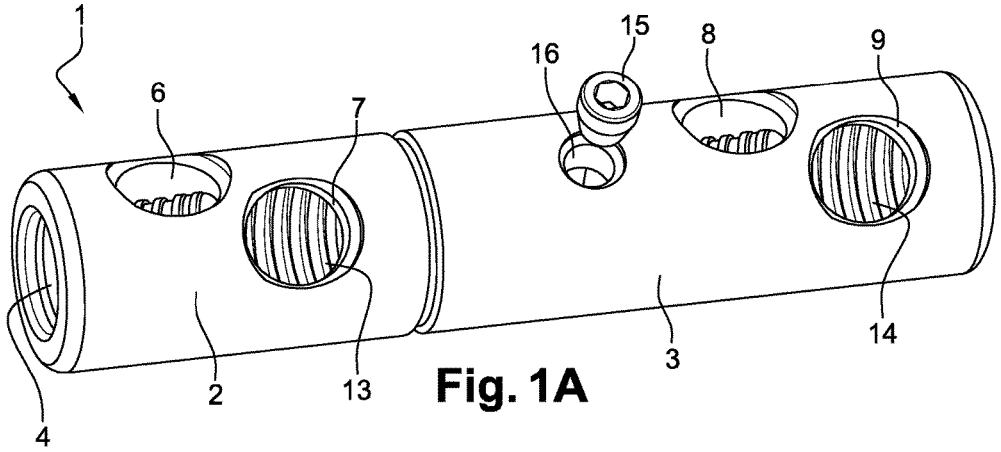
FIGS. 1A and 1B show a perspective view and a longitudinal cross section of a connector according to the invention according to a first embodiment.
Figure 1B:
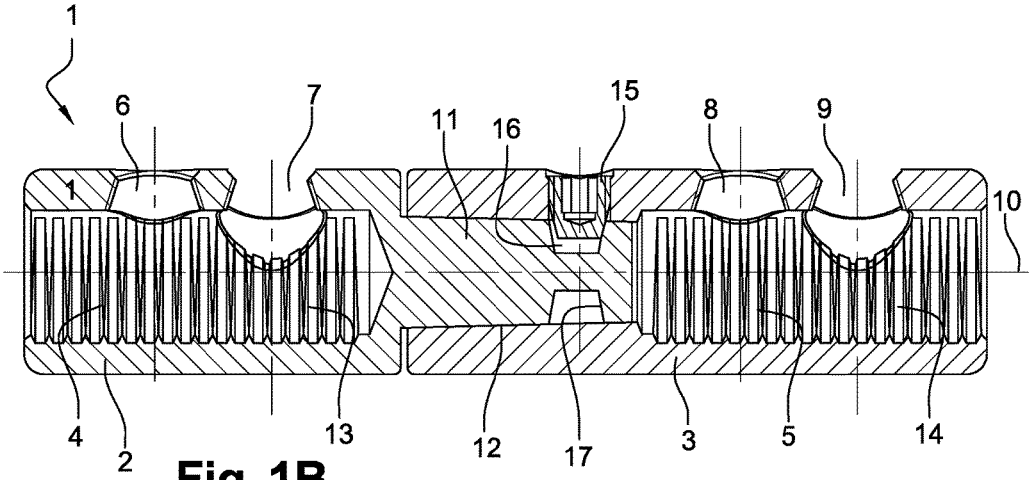

FIG. 1A illustrates a connector 1 according to a first preferred embodiment in a side view and in the operative position, which means in the closed position. FIG. 1B shows the same connector 1 in a longitudinal section and also in the operative position. The connector 1 includes a plug 2 and a socket 3. The plug 2 and the socket 3 each have an opening 4, 5 along their main axis, in which a stripped conductor of a cable (not shown) can be introduced so that it can be tightly connected with each connector part 2, 3. In the operative position, the main axis of the plug 2 and the socket 3 are parallel and coincide with the main- or connecting axis 10 of the connector 1. In the illustrated example, the conductor ends of the cable are screwed by means of screws into the plug 2 or the socket 3. Therefore, each of the plug 2 and the socket 3 have two bolt holes 6, 7, 8, 9 equipped with internal threading. The respective number of the bolt holes relates to the art and the application area of the connectors so that each projecting part of the screw, after tightly screwing the conductor, can be broken off and an even pipe shaped connector surface is preserved. The openings 4, 5 of the plug 2 and the socket 3, in which the stripped conductor ends are to be guided through, have each ring- or spiral shaped arranged pointy projections 13, 14 running along, which eventually break off the oxide layer on the stripped conductors and so then reduces the electrical resistance between the conductors and the connector parts 2, 3. The stripped conductor can also in other known ways be connected with the connector parts, for example, through crimping (pressure connection).

The plug 2 has a bolt 11 which protrudes in the longitudinal direction of the main axis 10 of the connector 1. The socket 3 has a hollow space 12 in the longitudinal direction of the main axis 10. The bolt 11 is pluggable in the hollow space 12 so that a releasable electrical contact between the conductors can be made. The two connector parts 2, 3 are composed, for example, of copper or aluminum. The connector parts 2, 3 are preferably composed of pure copper or pure aluminum, when each of these are to be connected to the conductors by crimping. When connecting the conductor with the connector parts 2, 3, the previously described bolting technique should be used, the connector parts 2, 3 preferably are composed of brass or aluminum alloy, because these materials are harder than pure copper of aluminum. Depending on the use of the connectors both connector parts 2, 3 can thereby be composed of the same metal or different metals.

According to the invention, the bolts 11 and the hollow space 12 have the identical truncated conical shape to each other, so that the bolts 11 are tightly placed in the hollow space 12 in the hollow space 12 in the operative position by self-locking. The self-locking mechanism can, for example, be lifted by a tensile force acting on the connector parts 2, 3. Without such a tensile load the connector 1 will remain securely in the operative position. In the operative position, the connectors 1 completely overlap the bolts 11 and the hollow space 12.

In the operative position the connector according to the invention can, for example, be approximately 140 mm to 260 mm long and can be connected together with an energy cable with cross sectional surfaces from approximately 95 $mm^2$ to 500 $mm^2$.

Figure 2:
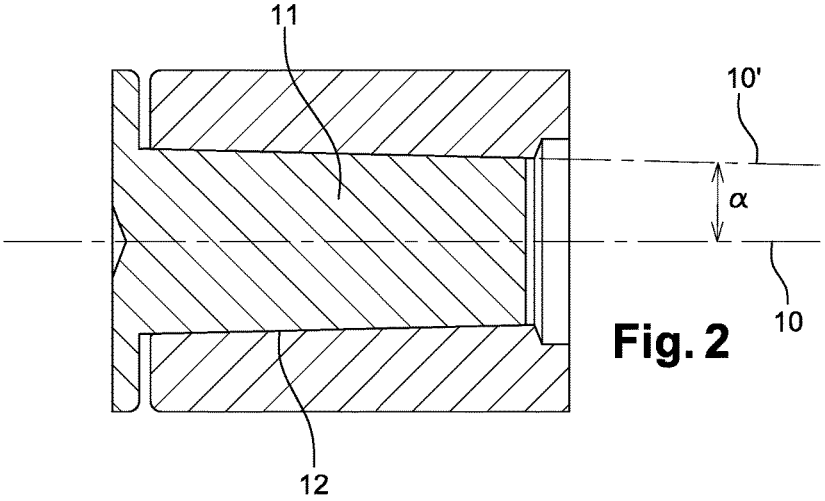
FIG. 2 shows a simplified detail of the connector according to FIG. 1B.

FIG. 2 shows a simplified detail out of the overlapping area of the connectors in the operative position, in which the bolt 11 is plugged into the hollow space 12. Illustrated in FIG. 2 are the surface line 10' and the conical axis of the truncated conical shape, which coincides with the main axis 10 of the connector. The truncated conical shape of the bolts 11 and the hollow space 12 are identical, so that in the operative position they have a common surface line 10' and a common conical axis 10. The angle $\alpha$ between the conical axis 10 and the surface line 10' advantageously has a worth between 0.2° and 10°. As a result, sufficient self-locking is ensured, and simultaneously allows the plug connection to be produced. The truncated cone corresponds preferably to a Morse taper according to DIN 228 and the angle $\alpha$ of the angle of inclination of the Morse taper.

In accordance with the invention connector 1, in addition to preventing self-locking in the operative position and to be able to use an energy cable connection in tensile stress, it advantageously includes a pin as locking means which interacts with a circumferential recess around the diameter of the pins 11. Examples of different locking means are illustrated in FIGS. 1A and 4B in connection with the connector 1 according to the invention.

In the examples in FIGS. 1A and 1B the locking means is composed of a screw 15 which is screwed into an opening 16 provided in the wall of the socket 3 for this purpose, at the level of the hollow space 12. The axis of the opening 16 perpendicularly intersects the main axis 10 of the connector 1. The screw 15 acts together with a circumferential recess 17 around the diameter of the bolts 11, for example a groove. By placing the screw 15 in the operative position an unwanted withdrawal of the plug 2 from the socket 3 can be prevented. Simultaneously, by means of the screw 15, additional contact force can be generated between the two truncated conical surfaces of the bolts 11 and the hollow space 12.

Figure 3A:
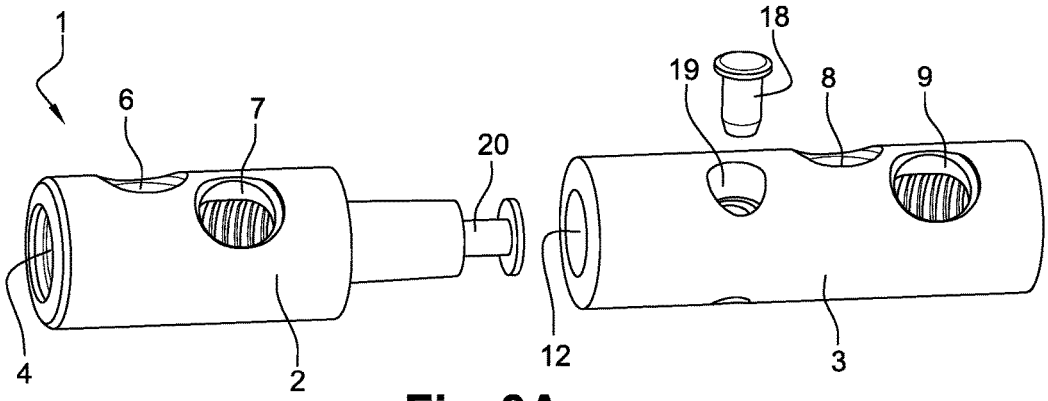
FIGS. 3A, 3B, and 3C show in a perspective view a longitudinal and a cross section of the connector according to the invention according to a second embodiment.
Figure 3B:
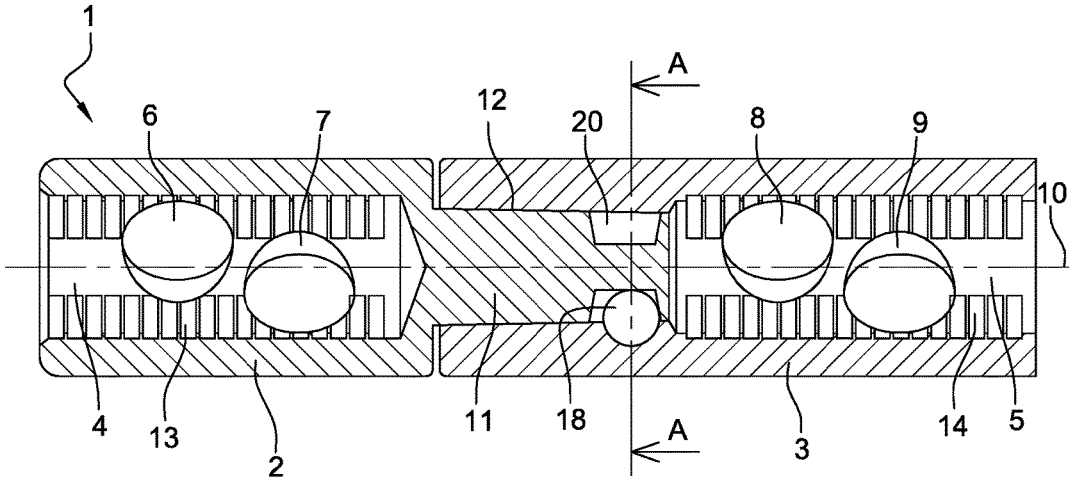
Figure 3C:
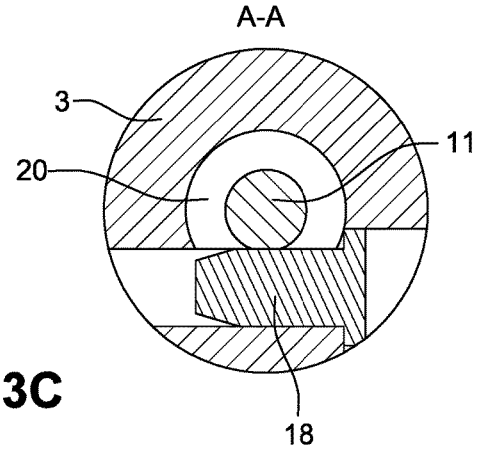

In FIG. 3A is a connector 1 according to a second previously illustrated embodiment illustrated in a side view and in the open position. FIG. 3B shows the same connector 1 in a longitudinal section and in the operative position. FIG. 3C shows a cross-section of the connector 1 along the intersecting line A-A illustrated in FIG. 3B. The locking means here surrounds a rivet or pin 18 which in the operative position is pressed into an opening 19 in the wall of the socket 3 provided for this purpose. The axis of the opening 19 is perpendicular to the main axis 10 of the connector 1, but does not cut this, that is the axis of the opening 19 forms a secant for the socket wall in the cross section described circle. The pin 18 acts together with a circumferential recess 20 surrounding the diameter of the bolts 11, for example a groove. The pin 18 slides thereby laterally in the circumferential groove 20 as shown in FIGS. 3B and 3C. By placing the screw 15 in the operative position, an unwanted withdrawal of the plug 2 from the socket 3 can be prevented. Locking with a pin constitutes a reasonable alternative to locking with a screw and requires no additional work tools.

Figure 4A:
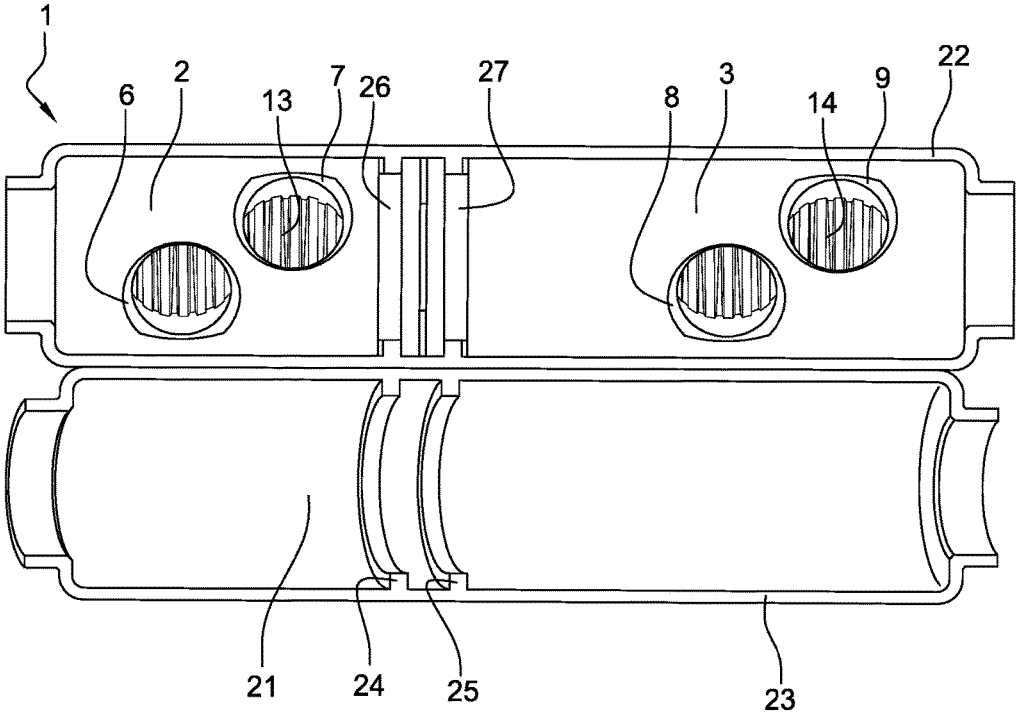
FIGS. 4A and 4B show a perspective view and a longitudinal view of a connector according to the invention according to a third embodiment.
Figure 4B:
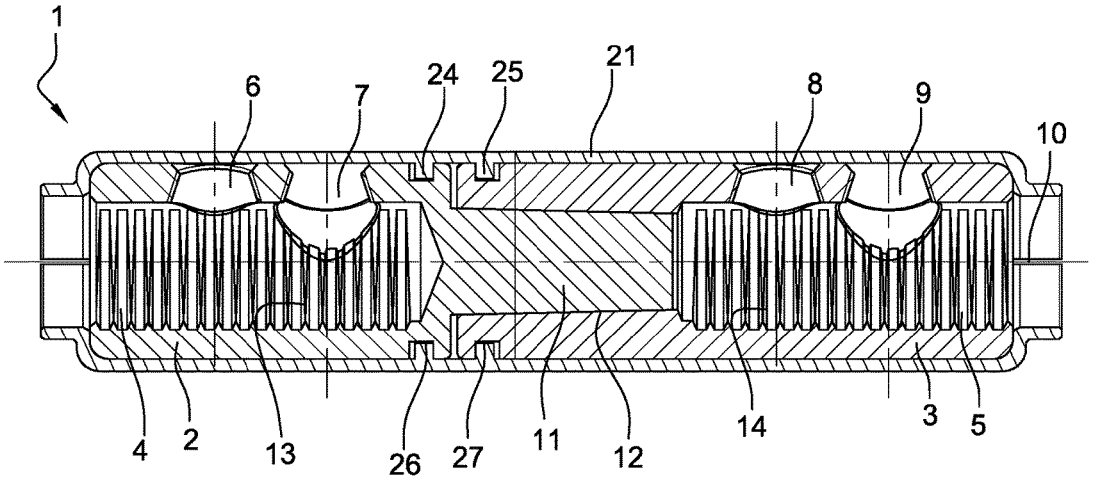

FIG. 4A illustrates a simplified (meaning without pin and recess illustrated) side view of a connector 1 according to a further embodiment shown in the operative position. FIG. 4B shows the same connector 1 in a longitudinal section and also in the operative position. As an additional locking means the connector is surrounded by a shell 21. The shell 21 is composed preferably of plastic. The shell 21 has on its inner upper surface two projections 24, 25, for example tongue in groove, protruding at right angles to the main axis 10 of the connector, which in each recess 26, 27, for example a groove, the socket and plug can be inserted. In the illustrated example, each of the tongue in groove and the groove are circumferentially around the inner diameter of the shell 21 and the outer diameter of the plug 2 or the socket 3. The shell 21 can, as illustrated in FIG. 4A for example, be composed of two halves 22, 23, which in the operative position longitudinally of the connector 1 can be joined together and which, for example, can be connected to each other with an integral hinge. FIG. 4A shows the shell 21 open. Alternatively, the shell can be composed of two halves, whereby each half is already attached to the socket 3 and the plug 2. When the connector 1 is brought into the operative position, simultaneously the shell will close. In both cases the shell 21 will, for example, lock by means of a locking mechanism.

Such a shell can be installed without additional tools and additionally prevents an unwanted unplugging of the plug 2 out of the socket 3 in the operative position. Moreover, the locking means offers by means of a plastic shell a protection against contact of IP2X (according to EN 60529).

A connection according to the invention includes the described connector 1 according to the invention as well as a rolling hose (not shown). The rolling hose is, as long as the connector is in the open position, arranged on one of the two cables. After the connector 1 is brought into the operative position, the rolling hose is rolled on the connector 1, so that the rolling hose reaches from the insulation of one cable to over the insulation of the other cable. As a result, all the metal pieces on and around the connector 1 are covered, so that the connector is electrically insulated and reliably protected against mechanical environmental influences. The rolling hose is composed for example out of a rubber material. Such a connector is especially quickly and simply manufactured.

The invention claimed is:

1. A connector for two electrical energy cables, wherein the connector has two connector parts, a plug and a socket, each having an opening along its main axis in which a stripped conductor of a cable can be introduced, and which is tightly connectable with a conductor of the cable, the plug and socket suitable to create a detachable electrical contact between the conductors, whereby the socket has a hollow space running in the longitudinal direction and the plug has a projecting bolt running in the longitudinal direction, which in the mounting position is inserted in the hollow space of the socket, whereby the hollow space of the socket and the outer surface of the plug have an identical truncated conical shape to each other, so that the plug is fixable in the hollow space of the socket, wherein the bolt has a circumferential recess, and wherein the connector further has a pin as a locking means, which is inserted into the recess in the mounting position, by which the bolt and socket are held in an operative position, whereby the pin is arranged so that the axis is right angled to a connector axis of the connector.

2. The connector according to claim 1, wherein the pin is a screw, which is arranged in an overlapping area of the socket and the plug in an opening of the socket and the recess of the bolt.

3. The connector according to claim 1, wherein the connector has a shell which locks the connector in the operative state.

4. The connector according to claim 3, wherein the shell has on its inner upper surface at least two right angle to the connecting axis of the connector protruding projections, which each are insertable in at least a recess of the socket and the plug.

5. The connector according to claim 4, wherein the projections are tongue in groove and the recess is a groove.

6. The connector according to claim 3, wherein the shell is composed of two halves which in the operative position longitudinally of the connector 1 can be joined together.

7. The connector according to claim 3, wherein the shell is composed of two halves, each of which is attached to the socket and the plug, so that by manufacturing the two halves can be joined in the operative position.

8. The connector according to claim 7, wherein an angle between a surface line and the conical axis of the truncated conical shape of the bolt and the hollow space has a value between 0.2° and 10°.

9. Connector according to claim 1, wherein the stripped conductor of the cable each with at least one screw or a shearing screw is locked in the socket and in the plug.

* * * * *